US006073787A

United States Patent [19]

Daugherty, Jr. et al.

[11] Patent Number: 6,073,787

[45] Date of Patent: Jun. 13, 2000

[54] CARRIER PLATE ASSEMBLY FOR A SLACKLESS DRAWBAR ASSEMBLY

[75] Inventors: David W. Daugherty, Jr., Plainfield; Scott Natschke, Kankakee, both of Ill.; Michael E. Ring, Crown Point, Ind.

[73] Assignee: Westinghouse Air Brake Company, Wilmerding, Pa.

[21] Appl. No.: 09/049,262

[22] Filed: Mar. 27, 1998

[51] Int. Cl.[7] ..... B61G 7/00

[52] U.S. Cl. ..... 213/50

[58] Field of Search ..... 213/50, 51, 56, 213/58, 59, 60, 61, 62 R, 54, 29

[56] References Cited

U.S. PATENT DOCUMENTS

| | | | |
|---|---|---|---|
| 4,531,648 | 7/1985 | Paton | 213/59 |
| 4,946,052 | 8/1990 | Kaim et al. | 213/61 |
| 5,558,238 | 9/1996 | Daugherty | 213/50 |

*Primary Examiner*—Mark T. Le
*Attorney, Agent, or Firm*—James Ray & Associates

[57] ABSTRACT

A carrier plate assembly for use in a slackless drawbar assembly to connect together, in a substantially semi-permanent fashion, adjacently disposed ends of a pair of railway freight cars. The carrier plate assembly includes a carrier plate member having a top surface and a bottom surface. A crushable support member has a bottom surface thereof engageable with at least a portion of the top surface of such carrier plate member. There is an aperture formed through the crushable support member and an anchoring mechanism is engageable with the carrier plate member and extends through such aperture formed in the crushable support member for securing a locking wedge member to the carrier plate in such slackless drawbar assembly. The anchoring mechanisms including at least a threaded portion for at least one of receiving a nut thereon and for threadedly engaging a threaded aperture formed in the locking wedge member to enable tightening of such locking wedge member to the carrier plate.

18 Claims, 7 Drawing Sheets

CARRIER PLATE ASSEMBLY FOR A SLACKLESS DRAWBAR ASSEMBLY

CROSS-REFERENCE TO RELATED APPLICATIONS

This patent application is closely related to our co-pending patent application Ser. No. 09/049,553, now allowed entitled "A Locking Wedge Assembly For A Slackless Drawbar Assembly" and to our co-pending patent application Ser. No. 09/049,519, now allowed as U.S. Pat. No. 5,979,679 issued on Nov. 9, 1999, entitled "A Method For Installing A Locking Wedge And Carrier Plate Assembly", both of which are being filed concurrently herewith. Each of these patent applications is assigned to the Westinghouse Air Brake Company, the assignee of the present invention, and their teachings are incorporated into the present document by reference thereto.

FIELD OF THE INVENTION

The present invention relates, in general, to slackless type drawbar assemblies which are used in the railway industry to couple together the adjacently disposed ends of a pair of railway type freight cars in a substantially semi-permanent fashion and, more particularly, this invention relates to a crushable support member which is positioned above a carrier plate so as to maintain a predetermined distance between the carrier plate and an object, particularly a locking wedge member, during the installation of the drawbar system. This crushable support member may then be crushed and/or flattened and left in place above the carrier plate once installation is complete. The present invention enables positioning of the components of the slackless drawbar system in place prior to tightening of such components in place within the center sill portion of a railway freight car.

BACKGROUND OF THE INVENTION

Slackless type drawbar assemblies have been well known in the railroad industry for several years as a means to connect together the adjacently disposed ends of a pair of railway freight cars in a substantially semi-permanent fashion, prior to the development of the present invention.

In other words, these railway freight cars do not require frequent separation during service. Normally they will only be separated during a required repair and/or routine maintenance being performed on one or more of them.

These particular railway cars are normally of the type used in what is most commonly referred to, in the railroad industry, as dedicated service. Railway freight cars of such dedicated service type will at least include: those cars which are normally utilized to haul coal, coke, and/or various other types of raw minerals; automotive type transport carriers, cars which are utilized in the transporting of various types of building materials and tank cars which are used to transport various types of liquid products.

Examples of some other raw minerals transported in these dedicated service railway freight cars include: various ores, cement and stone. The various types of liquids transported by such dedicated service railway tank cars will at least include a number of different chemicals. Building materials transported in this manner include: lumber, dry wall, plywood, paneling, etc.

A typical slackless type drawbar assembly comprises the following elements: a female connection member, a male connection member retained in such female connection member, a drawbar connected to such male connection member and at least one wedge member.

The present invention is particularly directed to the carrier plate portion of the slackless drawbar assembly and to maintaining the distance of this carrier plate from the locking wedge member during installation of the slackless drawbar assembly into the end portion of a center sill.

The carrier plate performs the function of holding the male connection member and locking wedge member in place during service. The present invention enables positioning of the locking wedge member with respect to the carrier plate during installation and it enables tightening of this locking wedge member to the carrier plate.

Another significant drawback of the known prior art is that one could not attach the slackless drawbar assembly unit as a whole to the carrier plate prior to its installation into the end of the center sill. The present invention provides for a means to overcome these problems in the prior art type slackless drawbar assemblies.

SUMMARY OF THE INVENTION

The present invention provides a crushable support member above the top surface of the carrier plate and, more particularly, between the top surface of the carrier plate and the bottom surface of the locking wedge member. This crushable support member maintains a distance between the carrier plate and the locking wedge member to provide a certain height to the locking wedge member during the installation of the slackless type drawbar system. Once the slackless drawbar assembly, carrier plate and locking wedge member are installed into the car center sill, the carrier plate is bolted or anchored to the flanges of the center sill. The bolt or anchoring means is then drawn tight with a nut. This nut is usually provided beneath the carrier plate, but could also be positioned above the locking wedge member. Tightening of the nut causes the locking wedge member to be drawn down to remove the space between all of the components between the front and rear draft lugs of a standard draft gear pocket or a custom designed pocket. During this operation, the crushable support member is crushed and/or flattened between the bottom of the locking wedge member and the top of the carrier plate. The crushable support member may then be left in place between the carrier plate and the locking wedge member once installation is complete or it may be broken apart during the installation process and removed from the assembly.

OBJECTS OF THE INVENTION

It is, therefore, one of the primary objects of the present invention to provide a means for maintaining the distance of the carrier plate from the bottom surface of the locking wedge member, thus providing a certain height of a locking wedge member with respect to this carrier plate during installation of the slackless drawbar system.

Another object of the present invention is to provide a means to enable attachment of the slackless drawbar assembly as a whole to the carrier plate prior to the installation of the slackless drawbar assembly into the center sill portion of the railway freight car.

Yet another object of the present invention is to provide a means for maintaining the distance of the carrier plate from the locking wedge member, thus providing a certain height for a locking wedge member during the installation of the slackless drawbar system which will prevent detrimental shifting of the locking wedge member during such installation.

Still yet another object of the present invention is to provide a means for maintaining the distance of the carrier plate from the locking wedge member, thus providing a certain height for a locking wedge member during the installation of the slackless drawbar system which is relatively inexpensive to produce.

A further object of the present invention is to provide a means for maintaining the distance of the carrier plate from the locking wedge member, thus providing a certain height of a locking wedge member during the installation of the slackless drawbar system which is easy to use.

In addition to the various objects and advantages of the present invention which have been discussed in some detail above, various other objects and advantages of the invention will become more readily apparent to those persons who are skilled in the relevant art from the following more detailed description of the invention, particularly, when such description is taken in conjunction with the attached drawing Figures and the appended claims.

Figure 1:
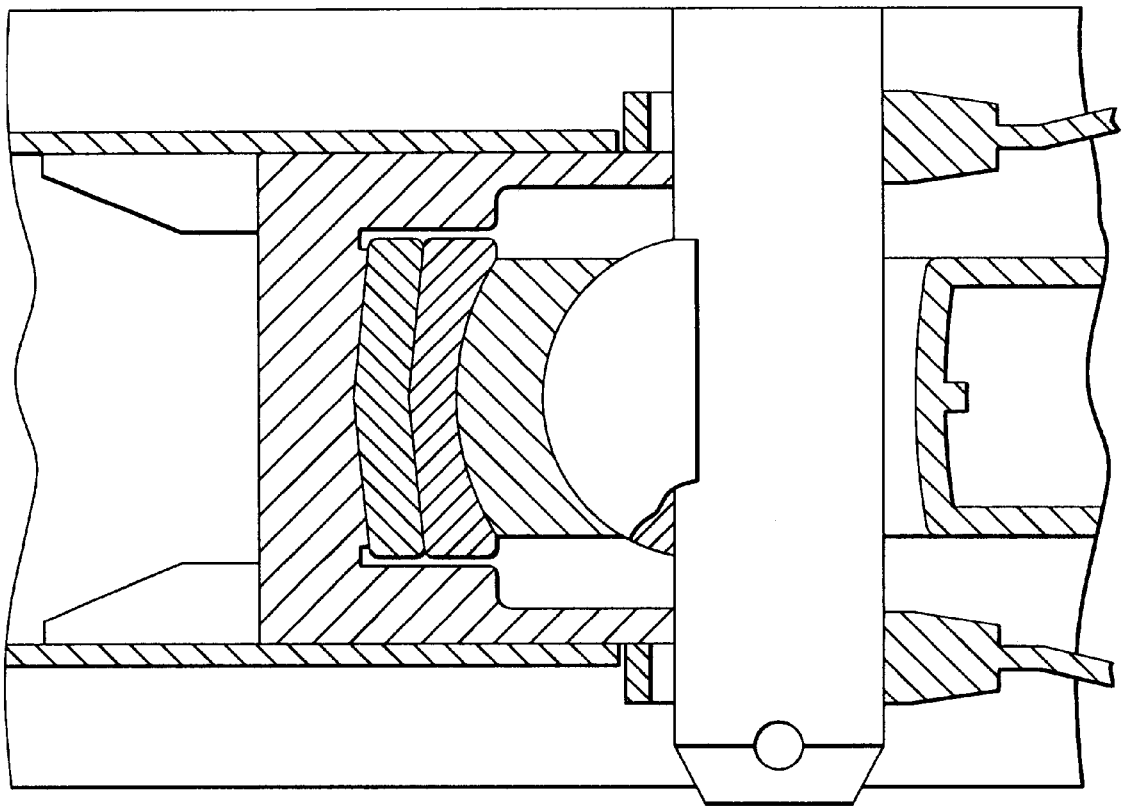
FIG. 1 PRIOR ART
FIG. 1 illustrates a slackless type drawbar assembly according to the prior art.

BRIEF DESCRIPTION OF THE PRESENTLY PREFERRED AND VARIOUS ALTERNATIVE EMBODIMENTS OF THE INVENTION

Prior to proceeding to the more detailed description of the present invention it should be noted that identical components, having identical functions, have been identified with identical reference numerals throughout the several views illustrated in the attached drawing Figures for the sake of clarity and understanding of the invention.

Reference is now made, more particularly, to the drawings. In FIG. 1, a slackless drawbar assembly of the prior art type has been illustrated and has, also, been discussed above in some detail.

Figure 2:
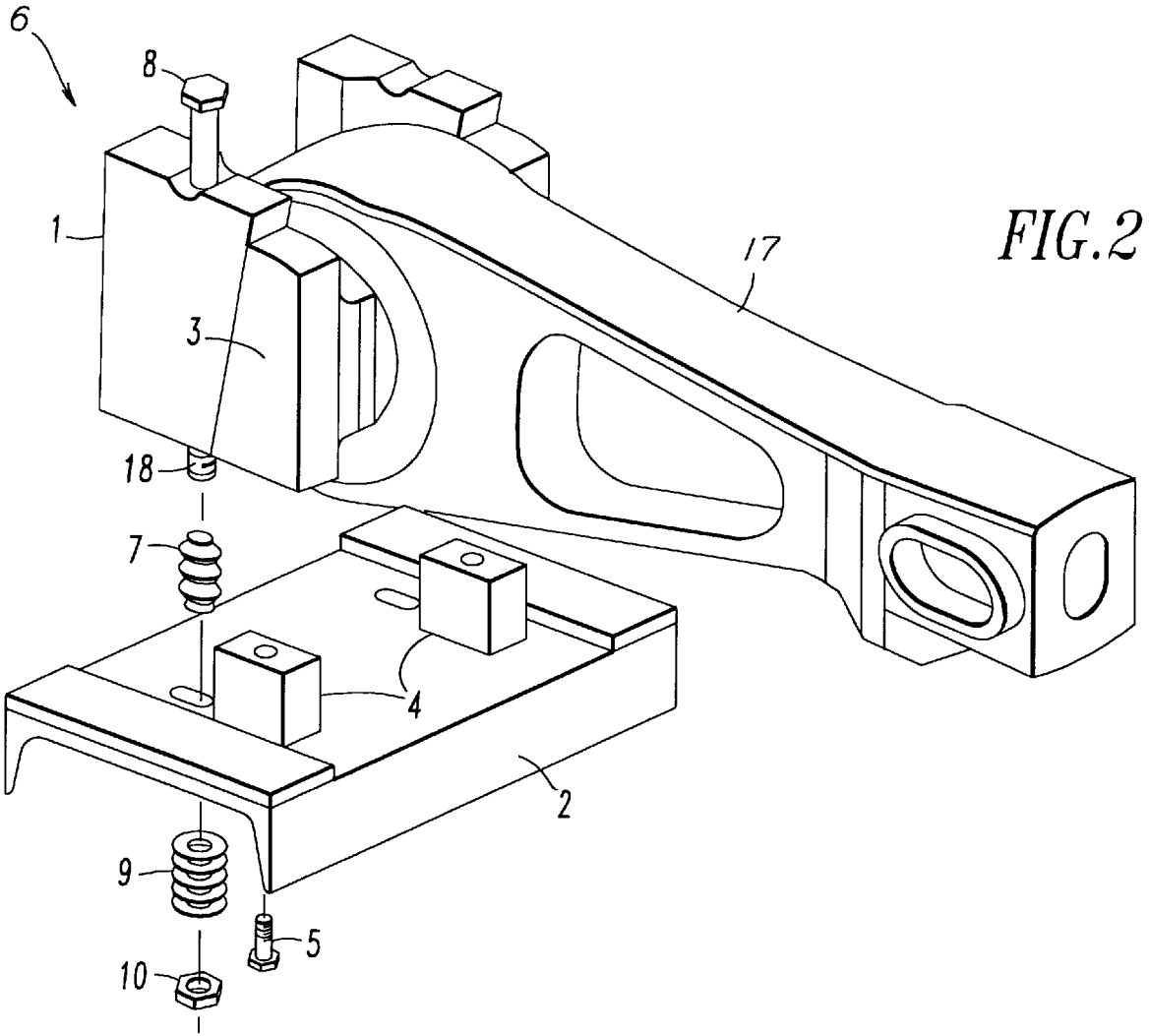
FIG. 2 illustrates an exploded perspective view of the locking wedge member and carrier plate portion of a slackless type drawbar assembly utilizing one presently preferred embodiment of the crushable support member according to the present invention.

Referring now to FIG. 2 which shows a presently preferred embodiment of a slackless drawbar assembly, generally designated 6, utilizing the crushable support member 7 of the present invention. The slackless drawbar assembly 6 includes a locking wedge member 1, a carrier plate 2, a pair of shafts 3, a pair of shaft support members 4, a shaft support anchoring means 5, a main drawbar portion 17 and a male connection portion of the slackless drawbar assembly 6.

Note that this male connection portion of the slackless drawbar assembly 6 is designed so that it mates with a female connection portion of a slackless drawbar assembly, this slackless drawbar assembly being positioned on an adjacently disposed end of a railway freight car so that connection of the railway cars may be achieved. The slackless drawbar assembly 6 also includes at least one crushable support member 7, of the present invention, which is positioned above the carrier plate 2 and engageable therewith.

This crushable support member 7, preferably, has an aperture therein and an anchoring means, or bolt 8, extends through this aperture. The anchoring means 8 is engageable with the carrier plate 2 and also includes at least one threaded portion 18 for receiving a nut 10 thereon to enable tightening of the carrier plate 2 in place in the slackless drawbar assembly.

FIG. 2 also shows the placement of belleville springs 9 between the nut 10 and the bottom surface of the carrier plate 2. The locking wedge member 1 is assembled with the carrier plate 2 by aligning the crushable support members 7 over the slots disposed in the carrier plate 2.

The locking wedge member 1 is positioned on the top of the crushable support member 7 such that an aperture in the locking wedge member 1, the crushable support member 7 and a corresponding slot formed in the carrier plate 2 are in alignment. The anchoring means 8 is then installed through the aperture formed in the locking wedge member 1, through the crushable support member 7 and through the slot of the carrier plate 2. Belleville springs 9 are then placed beneath the carrier plate 2 and a locknut 10 is applied onto the anchoring means 8. The nut 10 is tightened just enough to hold the locking wedge member 1 in place without distorting the crushable support member 7.

Figure 3:
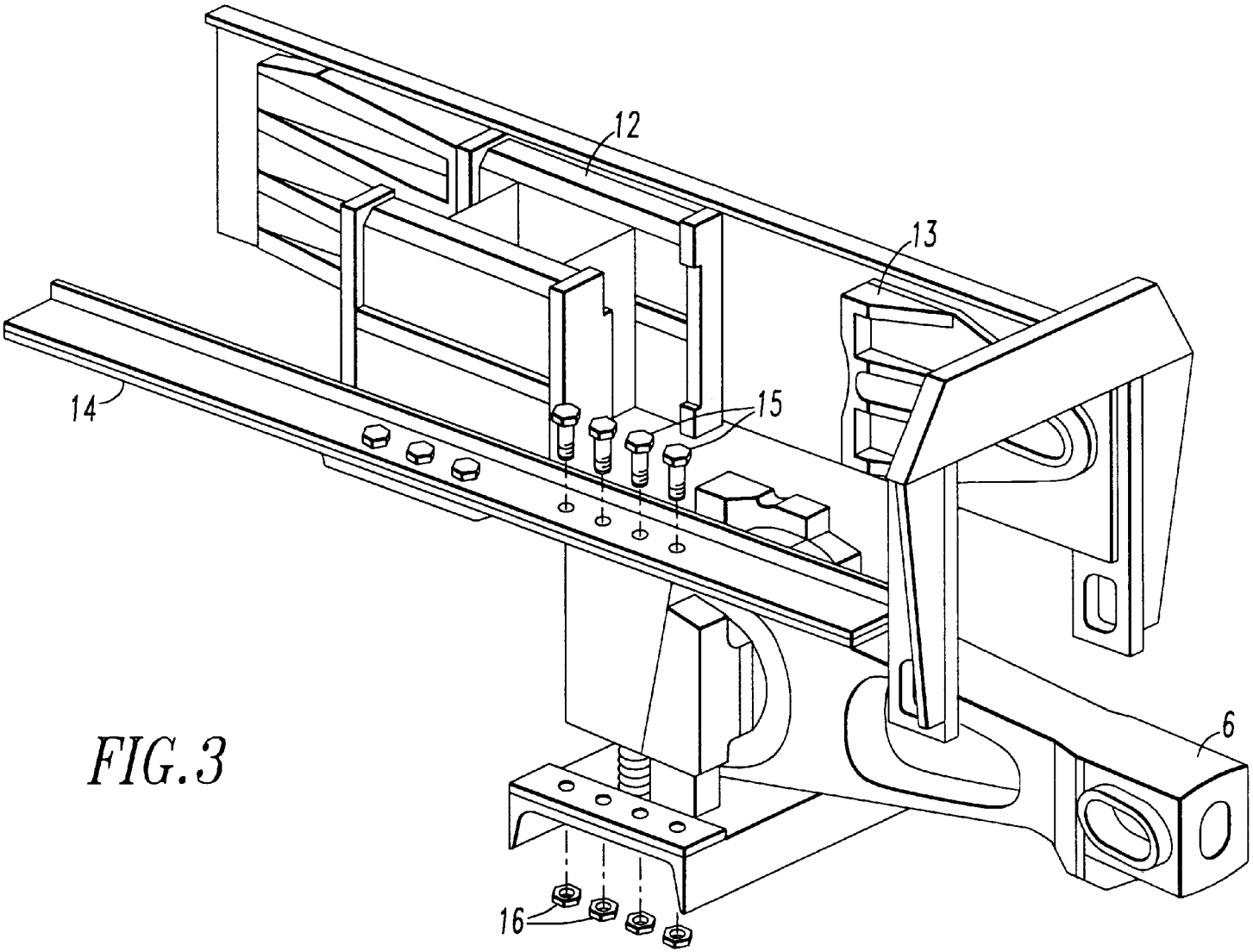
FIG. 3 illustrates an exploded perspective view of the presently preferred embodiment of the combination locking wedge member/carrier plate assembly, illustrated in FIG. 2, being positioned within the drawbar pocket in the center sill portion of a railway freight car.

Once the nut 10 has been tightened so as to hold the locking wedge member 1 in place, this entire assembly may then be raised into the drawbar pocket while aligning the holes in the carrier plate 2 assembly with holes in a center sill flange 14, as depicted in FIG. 3. The slackless drawbar system 6 is anchored in place via anchoring means 15 and locknuts 16.

The crushable support member 7 maintains the desired installation height of the locking wedge member 1 with respect to the carrier plate 2 during installation of the slackless drawbar system 6. Once the main drawbar portion 17, carrier plate 2 and locking wedge member 1 are installed into the car center sill, the carrier plate 2 is anchored, or bolted, to the flanges 14 of the car center sill.

Figure 4:
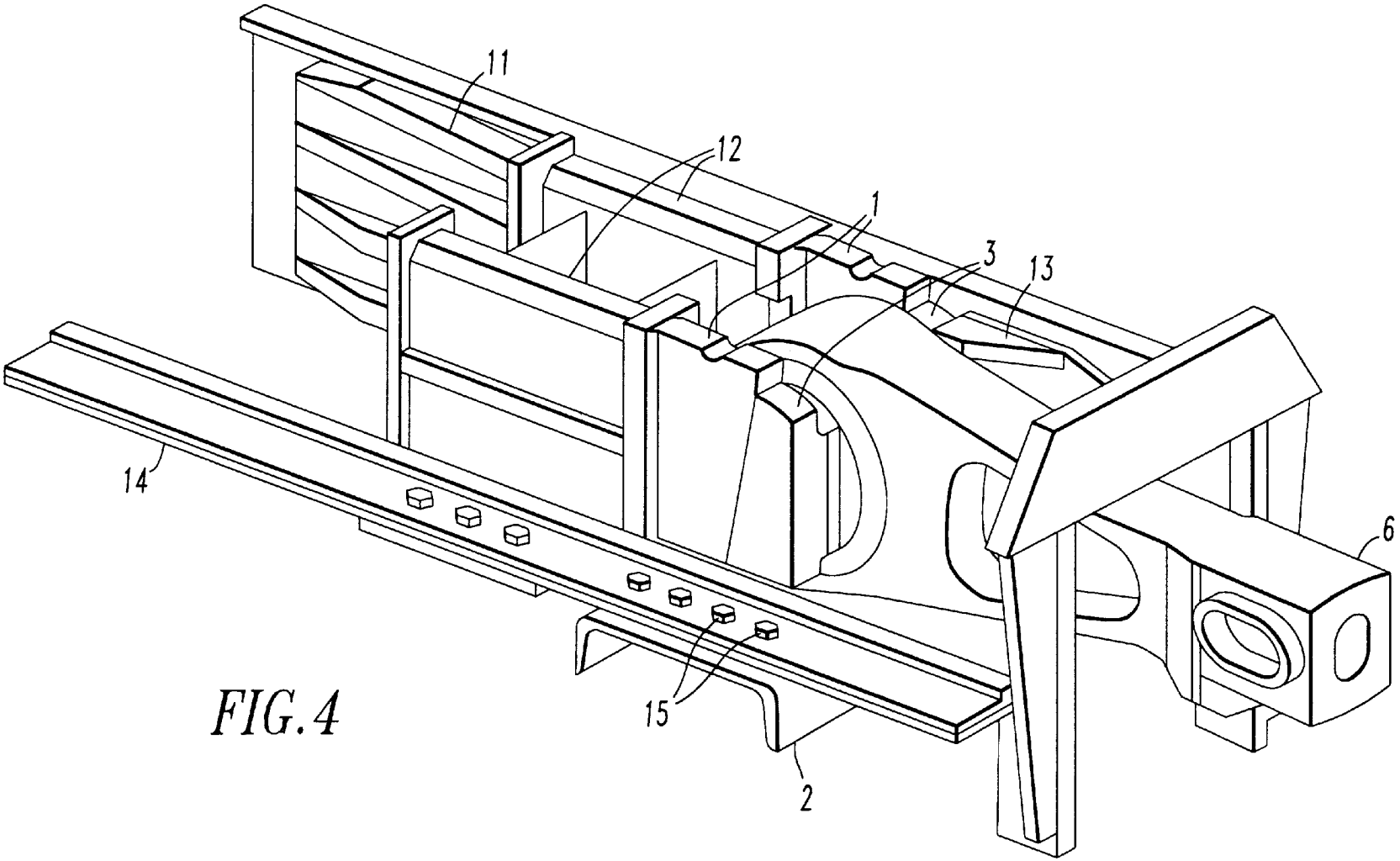
FIG. 4 illustrates a perspective view of the assembled slackless type drawbar system illustrated in FIGS. 3.

The anchoring means 8 positioned through the locking wedge member 1 is then drawn tight with the nut 10 thereby drawing the locking wedge member 1 down to remove the slack that exists between all of the components between the front and rear draft lugs of a standard draft gear pocket, or a custom designed pocket. During this operation, the crushable support member 7 is crushed and/or flattened between the bottom of the locking wedge member 1 and the top of the carrier plate 2. The crushable support member 7 is then left in place beneath the locking wedge member 1 when installation is complete. Although the invention has been described as using a single locking wedge member 1, a typical slackless drawbar system 6 would typically include at least two wedges, one positioned on either side of the main drawbar portion 17. FIG. 4 shows the slackless drawbar system 6 in an assembled condition.

Figure 5:
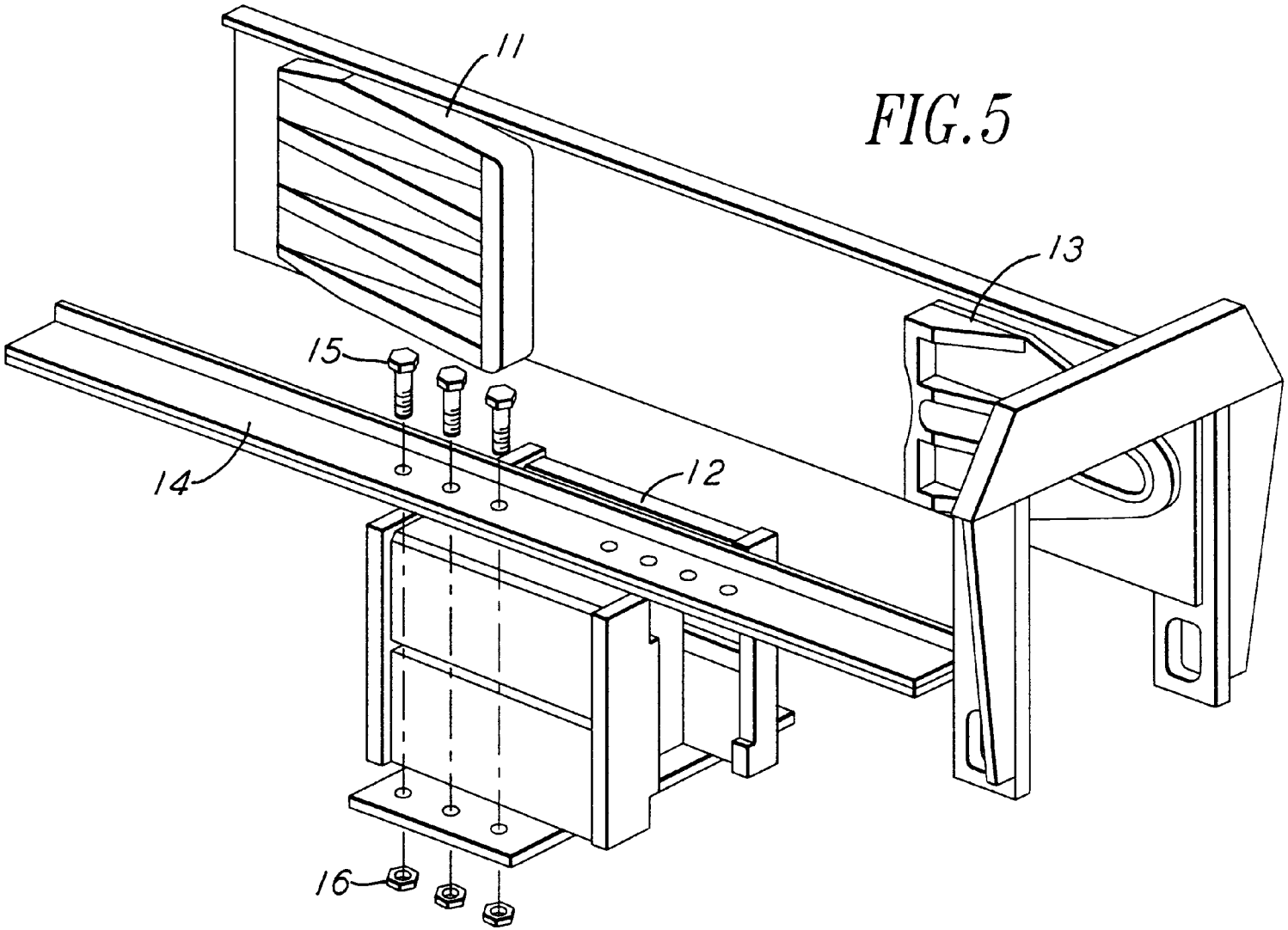
FIG. 5 illustrates an exploded perspective view of a filler block member ready to be positioned in the end of the center sill portion of a railway freight car to enable the use of the slackless type drawbar assembly, illustrated in FIGS. 3 and 4, in such freight cars previously equipped to use a standard railway coupling system.

FIG. 5 illustrates a perspective view of a filler block 12 to enable a slackless drawbar assembly to be retrofitted into the end portion of a center sill of a railway freight car. As seen in FIG. 5, the slackless drawbar assembly includes the rear draft stop 11 and the filler block 12 which will abut against the locking wedge member (not shown in FIG. 5). The filler block 12 is provided only in systems wherein existing drawbar assemblies have been converted to the slackless type systems. This filler block 12 is provided to fill in the space between the rear draft stop 11 and the locking wedge member so as to achieve a tight fit along the length of the assembly. Newly manufactured railway freight cars designed to use slackless drawbar assemblies do not require a filler block because these assemblies are constructed so that the rear draft stop 11 is butted up against the locking wedge member.

Figure 6:
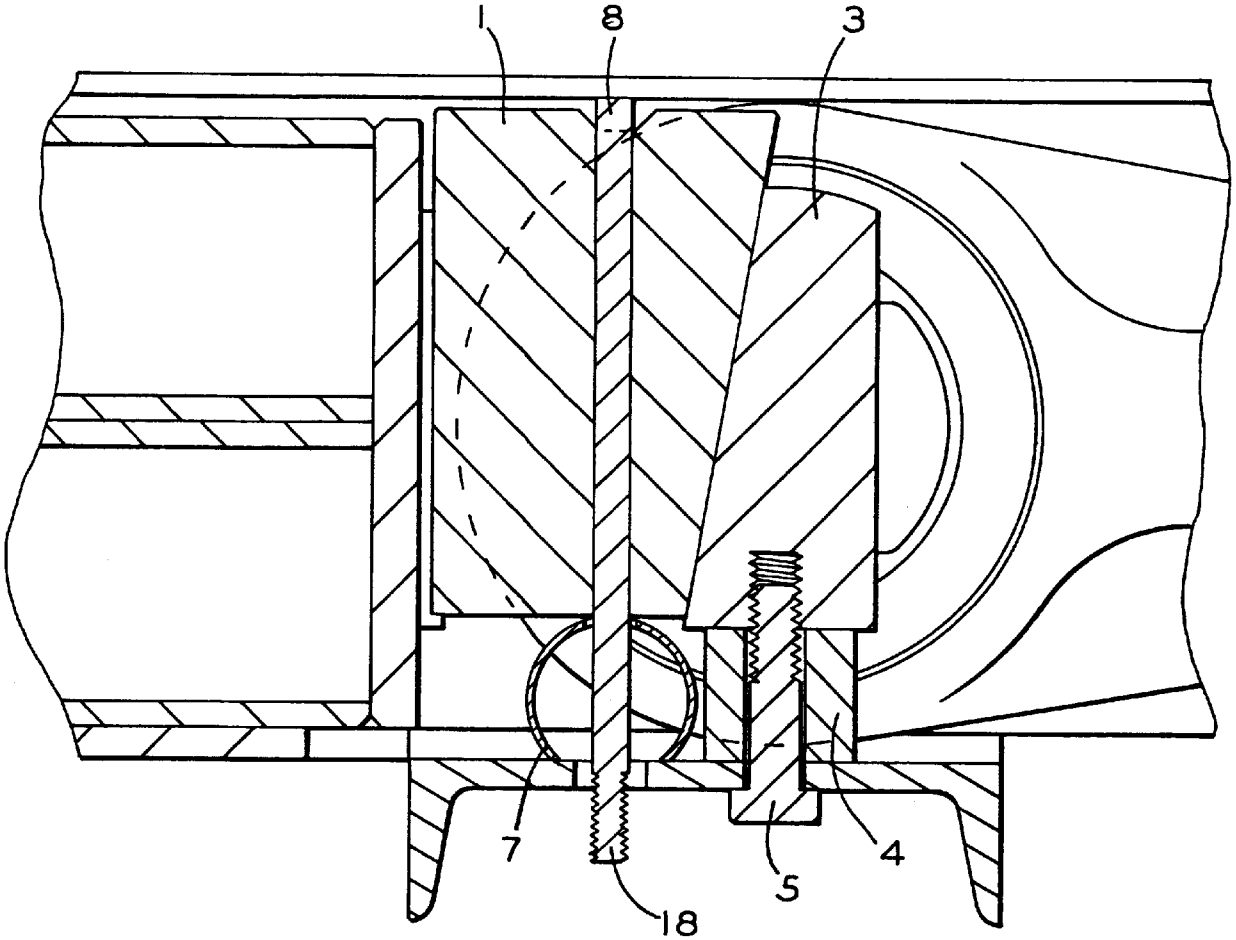
FIG. 6 illustrates a side view of the locking wedge member and carrier plate portion of a slackless type drawbar assembly utilizing an alternative embodiment of the crushable support member according to the present invention.
Figure 7:
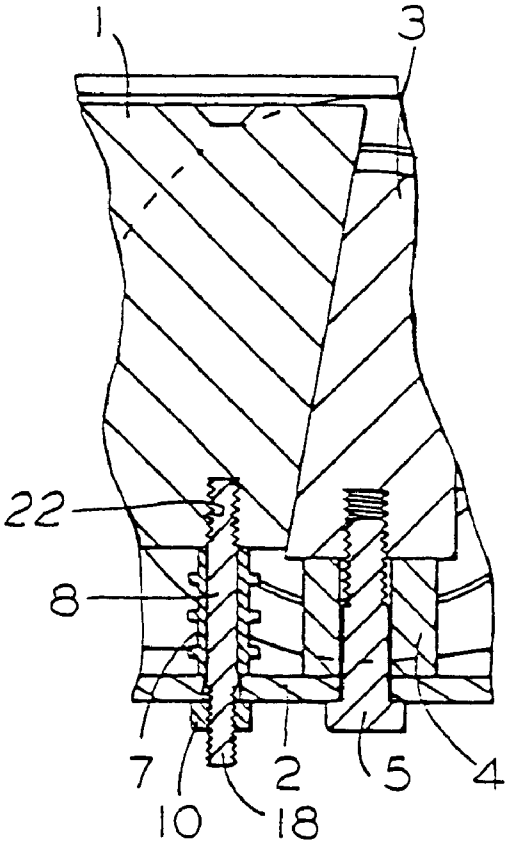
FIG. 7 illustrates a partial side view of the locking wedge member and carrier plate portion of a slackless type drawbar assembly showing the anchoring means threadedly engaging a threaded aperture formed in the locking wedge member.

The crushable support member 7, as shown in FIGS. 2, 3, and 7, comprises tubing in the shape of a vertically extending member having horizontally extending bellows along its height. FIG. 6 shows an alternative embodiment of the crushable support member 7 wherein this crushable support member 7 comprises tubing in the shape of a horizontally extending semi-circular member having a hole therein for enabling at least a portion of the anchoring means to extend therethrough.

Note that FIG. 2 shows the anchoring means extending through both the locking wedge member 1 and the carrier plate 2 and the tightening nut 10 being applied beneath the carrier plate 2. This showing is not intended to limit the invention to only this type of attachment of the anchoring means to the locking wedge member 1 and/or carrier plate 2. For example, FIG. 7 shows an embodiment wherein the anchoring means 8 threadedly engages a threaded aperture 22 formed in the locking wedge member 1. Also, it is not intended that this invention be limited to this particular location of the shown in the Figures, with respect to the locking wedge member 1.

Several different embodiments showing the attachment of the anchoring means to the locking wedge member 1 and to the carrier plate 2 and the location of the tightening nut 10 with respect to the locking wedge member 1 are taught and claimed in our co-pending application, entitled "A Locking Wedge Assembly For A Slackless Drawbar Assembly" and assigned Ser. No. 09/049,553, now allowed, which is being filed concurrently herewith and the teachings of which are incorporated into the present document by reference thereto.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

We claim:

1. A carrier plate assembly for use in a slackless drawbar assembly, said slackless drawbar assembly being designed to connect together, in a substantially semi-permanent fashion, adjacently disposed ends of a pair of railway cars, said carrier plate assembly comprising:

(a) a carrier plate member having a top surface and a bottom surface;

(b) a crushable support member having a bottom surface engageable with at least a portion of said top surface of said carrier plate member;

(c) an aperture formed through said crushable support member; and (d) an anchoring means engageable with said carrier plate member and extending through said aperture formed in said crushable support member for securing a locking wedge member to said carrier plate member in such slackless drawbar assembly, said anchoring means including at least a threaded portion for receiving a nut thereon or for threadedly engaging a threaded aperture formed in said locking wedge member to enable tightening of said locking wedge member to said carrier plate.

2. A carrier plate assembly as recited in claim 1 wherein said anchoring means attaches said carrier plate member to said locking wedge member and removes all slack present in said slackless drawbar system assembly.

3. A carrier plate assembly as recited in claim 2 wherein said threaded portion of said anchoring means extends above a top surface of said crushable support member.

4. A carrier plate assembly as recited in claim 3 wherein said threaded portion of said anchoring means extends through an aperture in said locking wedge member.

5. A carrier plate assembly as recited in claim 1 wherein said carrier plate assembly further includes a pair of radially opposed shaft support members disposed on said top surface of said carrier plate member supporting a respective shaft member carried by a male connection member.

6. A carrier plate assembly as recited in claim 5 wherein said pair of shaft support members include a vertically extending aperture therethrough for receiving a bolt therein to secure said shaft support members and said respective shaft member to said carrier plate member.

7. A carrier plate assembly as recited in claim 1 wherein said carrier plate assembly further includes a means for securing said carrier plate assembly to a flange portion of a center sill.

8. A carrier plate assembly as recited in claim 7 wherein said means for securing said carrier plate assembly to such flange portion of such center sill is a predetermined plurality of bolts.

9. A carrier plate assembly as recited in claim 2 wherein said crushable support member includes tubing which is capable of maintaining said locking wedge member at a certain height with respect to said carrier plate member during installation of said locking wedge member, said carrier plate member and said slackless drawbar assembly into a center sill.

10. A carrier plate assembly as recited in claim 9 wherein said crushable support member is capable of being crushed when said locking wedge member is tightened in place.

11. A carrier plate assembly as recited in claim 9 wherein said crushable support member includes tubing which is capable of maintaining said locking wedge member at a certain height with respect to said carrier plate member during installation of said locking wedge member, said carrier plate member and said slackless drawbar assembly into a center sill.

12. A carrier plate assembly as recited in claim 9 wherein said tubing includes a horizontally extending semi-circular member having a hole therein for enabling at least a portion of said anchoring means to extend therethrough.

13. A carrier plate assembly for use in retrofitting a slackless drawbar assembly into a center sill of a railway freight car equipped to use a standard coupler, said slackless drawbar assembly being designed to connect together, in a substantially semi-permanent fashion, adjacently disposed ends of a pair of railway cars, said carrier plate assembly comprising:

(a) a carrier plate member having a top surface and a bottom surface;

(b) a crushable support member having a bottom surface engageable with at least a portion of said top surface of said carrier plate member;

(c) an aperture formed through said crushable support member;

(d) an anchoring means engageable with said carrier plate member and extending through said aperture formed in said crushable support member for securing a locking wedge member to said carrier plate member in such slackless drawbar assembly, said anchoring means including at least a threaded portion for at least one of receiving a nut thereon and for threadedly engaging a threaded aperture formed in said locking wedge member to enable tightening of said locking wedge member to said carrier plate member;

(e) a filler block member engageable with a rear draft stop secured to such center sill; and (f) a pair of radially opposed shaft support members disposed on said top surface of said carrier plate member to support a pair of shaft members carried by a male connection member of said slackless drawbar assembly.

14. A carrier plate assembly for use in retrofitting a slackless drawbar assembly into a center sill of a railway freight car equipped to use a standard coupler as recited in claim 13, wherein said filler block member is a fabricated member.

15. A carrier plate assembly for use in retrofitting a slackless drawbar assembly into a center sill of a railway freight car equipped to use a standard coupler, said slackless drawbar assembly being designed to connect together, in a substantially semi-permanent fashion, adjacently disposed ends of a pair of railway cars, said carrier plate assembly comprising:

(a) a carrier plate member having a top surface and a bottom surface;

(b) a crushable support member having a bottom surface engageable with at least a portion of said top surface of said carrier plate member;

(c) an aperture formed through said crushable support member;

(d) an anchoring means engageable with said carrier plate member and extending through said aperture formed in said crushable support member for securing a locking wedge member to said carrier plate member in such slackless drawbar assembly, said anchoring means including at least a threaded portion for a t least one of receiving a nut thereon and for threadedly engaging a threaded aperture formed in said locking wedge member to enable tightening of said lokcing wedge member to said carrier plate member;

(e) a filler block member engageable with a rear draft stop secured to such center still; and (f) A pair of radially opposed shaft support members disposed on said top surface of said carrier plate member to support a pair of shaft members carried by a male connection member of said slackless drawbar assembly.

16. A carrier plate assembly for use in retrofitting a slackless drawbar assembly into a center sill of a railway freight car equipped to use a standard coupler as recited in claim 13, wherein said carrier plate member is formed as a channel member.

17. A carrier plate assembly for use in retrofitting a slackless drawbar assembly into a center sill of a railway freight car equipped to use a standard coupler as recited in claim 13, wherein said filler block member is carried by a separate carrier plate member.

18. A carrier plate assembly for use in retrofitting a slackless drawbar assembly into a center sill of a railway freight car equipped to use a standard coupler as recited in claim 17, wherein said separate carrier plate member is a steel plate.

* * * * *